US007267730B2

(12) United States Patent
Inoue et al.

(10) Patent No.: US 7,267,730 B2
(45) Date of Patent: Sep. 11, 2007

(54) FERRITE STAINLESS STEEL FOR AUTOMOBILE EXHAUST SYSTEM MEMBER SUPERIOR IN THERMAL FATIGUE STRENGTH

(75) Inventors: Yoshiharu Inoue, Futtsu (JP); Masao Kikuchi, Futtsu (JP); Haruhiko Kajimura, Tokyo (JP); Nobuhiko Hiraide, Tokyo (JP); Yasuhisa Tanaka, Toyota (JP); Yosuke Sumi, Toyota (JP)

(73) Assignees: Nippon Steel & Sumikin Stainless Steel Corporation, Tokyo (JP); Toyota Jidosha Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 11/097,772

(22) Filed: Apr. 1, 2005

(65) Prior Publication Data

US 2005/0217765 A1 Oct. 6, 2005

(30) Foreign Application Priority Data

Apr. 2, 2004 (JP) ..... 2004-109995

(51) Int. Cl.
*C22C 38/00* (2006.01)
*C22C 38/22* (2006.01)

(52) U.S. Cl. ..... 148/325; 148/326; 420/34; 420/64

(58) Field of Classification Search ..... 148/325, 148/326, 34; 420/64
See application file for complete search history.

(56) References Cited

U.S. PATENT DOCUMENTS 5,427,634 A 6/1995 Fujita et al.

FOREIGN PATENT DOCUMENTS

| | | |
|---|---|---|
| JP | 3021656 | 10/1993 |
| JP | 06-100990 | 4/1994 |
| JP | 09049066 | * 2/1997 |
| JP | 2001294990 | * 10/2001 |
| JP | 3242007 | 12/2001 |
| JP | 2004060009 | * 2/2004 |
| KR | 1999-014738 | 2/1999 |
| WO | WO93/21356 | 10/1993 |
| WO | WO97/34020 | 9/1997 |

OTHER PUBLICATIONS

Camp-Isij, vol. 16 (2003)-544, Mar. 1, 2003.

* cited by examiner

*Primary Examiner*—Sikyin Ip
(74) *Attorney, Agent, or Firm*—Kenyon & Kenyon LLP

(57) ABSTRACT

A ferrite stainless steel for an automobile exhaust system member superior in thermal fatigue strength comprised of, by wt %, C: 0.020% or less, Si: 0.02 to 0.15%, Mn: 0.05 to 0.20%, P: 0.040% or less, S: 0.010% or less, Al: 0.005 to 0.10%, N: 0.020% or less, Cr: 15 to 18%, Mo: 1.5 to 2.0%, Ti: 3×(C+N) to 0.25%, Nb: 0.4 to 0.8%, B: 0.0003 to 0.0050%, the C and N satisfying the relationship of C+N: 0.030% or less, and the Al, Si, and Mn satisfying the relationship of Al×(Si+Mn): 0.001 to 0.020, and a balance of Fe and unavoidable impurities. The 0.2% proof stress at 900° C. before heat treatment in the atmosphere at 900° C. for 300 hours is at least 15 MPa, and a difference of the 0.2% proof stress before and after the heat treatment is not more than 5 MPa.

2 Claims, 1 Drawing Sheet

FERRITE STAINLESS STEEL FOR AUTOMOBILE EXHAUST SYSTEM MEMBER SUPERIOR IN THERMAL FATIGUE STRENGTH

BACKGROUND OF THE INVENTION

1. Field of the Invention

The present invention relates to a ferrite stainless steel superior in thermal fatigue strength usable for a muffler, exhaust manifold, or other automobile exhaust system member.

2. Description of the Related Art

Due to the rise in interest in environmental issues, improvement of the fuel economy of automobiles and in turn reduction of the weight of vehicles are being strongly demanded. Further, purification of the exhaust gas of vehicles is earnestly desired. In view of this, stainless steel has been used for automobile exhaust system members. One of the members exposed to the highest temperatures, that is, the exhaust manifold, is repeatedly subjected to a rise in temperature to as high as 1000° C. and a drop in temperature to ordinary temperature, so requires superior heat resistance, in particular thermal fatigue strength.

In recent years, the usage temperature of exhaust manifolds has risen further. Steels are therefore being developed which can handle temperatures of 950° C. For example, Japanese Unexamined Patent Publication (Kokai) No. 06-100990 discloses a stainless steel containing 18 to 22% of Cr, 1.0 to 2.0% of Mo, and 0.1 to 1.0% of Nb. At the present time, as a 950° C. compatible exhaust manifold material, 19% Cr-2% Mo-based and other ferrite stainless steels called "SUS444" steels in JIS standard are being used.

The superior high temperature strength of ferrite stainless steel is considered to be due to the strengthening of the dissolved Nb and Mo contained in the steel. If exposed to a high temperature over a long period of time, however, the dissolved Nb and Mo precipitate, so the dissolved amounts fall and the high temperature strength ends up falling, that is, the thermal fatigue strength falls. As a method for preventing such a drop in high temperature strength, Japanese Patent No. 3021656 discloses to add Nb and Ti together to suppress the precipitation of the Nb.

Further, Hirasawa et al., CAMP-ISIJ, vol. 16 (2003), p. 544 reports that when reducing the amount of Si in a 14% Cr—Mo—Nb ferrite stainless steel from 0.9% to 0.35%, the dissolved Mo increases and the high temperature strength rises. Further, Japanese Patent No. 3242007 discloses a ferrite stainless steel for an automobile exhaust system member superior in oxide scale resistance. This steel improves the oxide scale resistance by lowering the Si.

However, it has been found that the problem of the drop in the high temperature strength after high temperature aging and the drop in the thermal fatigue strength cannot be sufficiently solved even with the technology described in Japanese Patent No. 3021656. Further, the high temperature strength dealt with in Hirasawa et al. CAMP-ISIJ, vol. 16 (2003), p. 544 is the initial high temperature strength. That publication does not disclose anything means for solving the problem of the thermal fatigue strength. Further, Japanese Patent No. 3242007 does not describe anything regarding thermal fatigue strength. In addition, the steel of that patent is low in Si and free of Al and therefore has almost no deoxidizing elements, so has the problem of extremely difficult deoxidation and precise control of composition.

SUMMARY OF THE INVENTION

An object of the present invention is to provide a ferrite stainless steel superior in thermal fatigue strength useful as an automobile exhaust system member, in particular an exhaust manifold.

The gist of the present invention for achieving this object is as follows:

(1) A ferrite stainless steel for an automobile exhaust system member superior in thermal fatigue strength comprised of, by wt %, C: 0.020% or less,
Si: 0.02 to 0.15%,
Mn: 0.05 to 0.20%,
P: 0.040% or less,
S: 0.010% or less,
Al: 0.005 to 0.10%,
N: 0.020% or less,
Cr: 15 to 18%,
Mo: 1.5 to 2.0%,
Ti: 3×(C+N) to 0.25%,
Nb: 0.4 to 0.8%,
B: 0.0003 to 0.0050% the C and N satisfying the relationship of C+N: 0.030% or less, and the Al, Si, and Mn satisfying the relationship of Al×(Si+Mn): 0.001 to 0.020, and a balance of Fe and unavoidable impurities.

(2) A ferrite stainless steel for an automobile exhaust system member superior in thermal fatigue strength as set forth in (1), wherein the 0.2% proof stress at 900° C. before heat treatment in the atmosphere at 900° C. for 300 hours is at least 15 MPa and wherein a difference of the 0.2% proof stress before and after the heat treatment is not more than 5 MPa.

BRIEF DESCRIPTION OF THE DRAWINGS

These and other objects and features of the present invention will become clearer from the following description of the preferred embodiments given with reference to the attached drawing.

DESCRIPTION OF THE PREFERRED EMBODIMENTS

Figure 1:
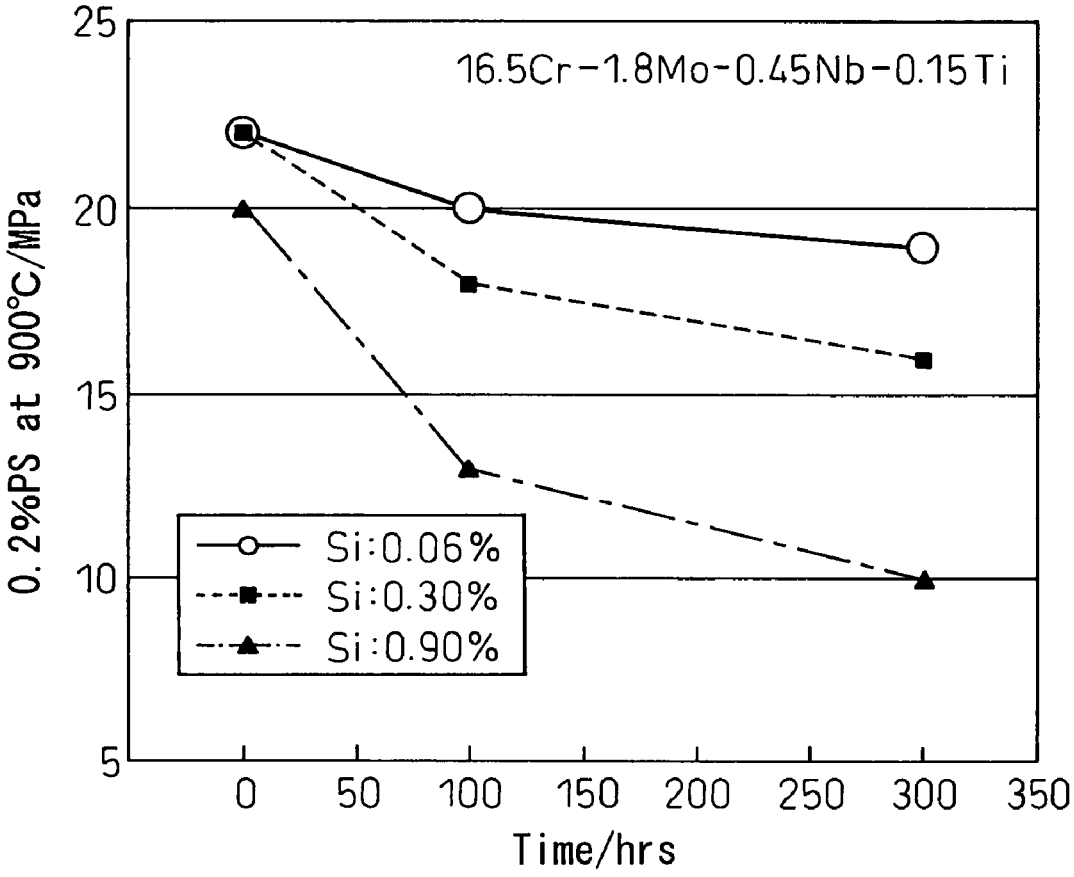
FIG. 1 is a graph of the effect of heat treatment at 900° C. for 300 hours and the amount of Si on the high temperature strength of 16% Cr-1.8% Mo-0.45% Nb-0.15% Ti-based ferrite stainless steel (0.2% proof stress at 900° C).

Preferred embodiments of the present invention will be described in detail below while referring to the attached figures. The inventors studied materials having the optimal properties as automobile exhaust system members, in particular as exhaust manifolds having maximum temperatures of about 1000° C. The properties required as a material for an exhaust manifold are heat resistance (high temperature strength and oxidation resistance) and formability. With high temperature strength, the initial strength alone is not enough. It is desirable that the high temperature strength not drop even after heat history. With heat resistant ferrite stainless steel, however, normally the dissolved Nb and Mo provide the high temperature strength. If the steel is exposed to a high temperature environment, the Nb and Mo precipitate. The dissolved amounts drop as a result. As a result, the high temperature strength ends up dropping unavoidably. The formability has to be of an extent enabling shaping to the shape required for an exhaust manifold.

The inventors studied materials optimal for exhaust manifold applications and as a result confirmed the following when a Cr—Mo—Nb—Ti ferrite stainless steel is exposed to a high temperature environment of about 900° C.:

1) The content of Ti suppresses the production of Nb-based carbonitrides, but cannot suppress the production of a Laves phase $Fe_2$ (Nb, Mo) including Nb and Mo, 2) When including Mo, the precipitation of a Laves phase $Fe_2$ (Nb, Mo) including Nb and Mo is remarkable.

3) When including Si, the precipitation of a Laves phase $Fe_2$ (Nb, Mo) including Nb and Mo is remarkable.

That is, the inventors discovered to prevent a drop in the dissolved amounts due to precipitation of Nb and Mo in a system including Nb and Mo, it is advantageous to restrict the amount of Si in addition to adding Ti. Further, as shown in FIG. 1, they ran aging tests at 900° C. for 300 hours on three types of steel comprised of 16% Cr-1.8% Mo-0.45% Nb-0.15% Ti having Si contents of 0.06%, 0.30%, and 0.90%. As a result, the initial strength, that is, the 0.2% proof stress at 900° C. before the test, was substantially the same for the 0.06% Si steel and 0.30% Si steel and somewhat low for the 0.90% Si steel. The 0.2% proof stress after aging at 900° C. for 300 hours was highest with the 0.06% Si steel followed by the 0.30% Si steel and 0.90% Si steel. The difference with the initial strength was a small 3 MPa with the 0.06% Si steel, but was 6 MPa with the 0.30% Si steel and 8 MPa with the 0.90% Si steel. From the above, it is learned that by reducing the amount of Si from 0.30% to 0.06%, the initial strength is the same, but the high temperature strength after aging is high, that is, the thermal fatigue strength is superior.

To sharply limit the Si, other deoxidizing elements, that is, Mn and Al have to be used, but Mn causes the growth of oxide scale, so it also has to be reduced as much as possible. Further, if the content of Al increases, the high temperature thermal fatigue strength due to the internal oxidation also drops, so not that much can be added either. Deoxidation with low Si, Mn, and Al is extremely difficult, so the inventors studies the optimum relationship among Al, Si, and Mn based on addition of Al. As a result, they discovered that by keeping the relationship expressed by Al×(Si+Mn) within a certain range, sufficient deoxidation by an ordinary converter or secondary refining becomes possible and the variation in composition becomes smaller.

Further, the inventors discovered that the addition of B improves the thermal fatigue strength. It is considered that B segregates at the grain boundaries, so suppresses grain growth at the time of exposure to a high temperature environment.

From the results of the above study, the inventors thought it might be desirable to sharply limit the Si by a Cr—Mo—Nb—Ti system for a material of an exhaust manifold and add Al and B and engaged in further detailed studies whereupon they completed the present invention.

Next, the conditions for limiting the ingredients will be explained. C is an unavoidable impurity included in steel. It degrades the formability and corrosion resistance, so its content is desirably as small as possible. It may be stabilized as a carbonitride to eliminate its harmful actions, but the upper limit of its content is made 0.020% to reduce the amount of addition of the stabilizing agent Ti as much as possible. Note that reduction to less than 0.002% increases the cost in refining, so it is also possible to set a lower limit of 0.002%.

Si is an element improving the oxidation resistance. Heat resistant stainless steel normally has 0.3 to 1% or so added to it. However, the inventors newly discovered that Si has an effect of degrading the thermal fatigue strength. FIG. 1 shows the 0.2% proof stress at 900° C. after aging at 900° C. for 0 to 300 hours. The heat treatment has substantially the same initial strength at 900° C. with the 0.06% Si steel and 0.30% Si steel, but the drop in the high temperature strength after aging is smaller with the 0.06% Si steel or less than 3 MPa. With the 0.30% Si steel, the drop was as much as 8 MPa. That is, it became clear that reducing the Si improves the thermal fatigue strength. Therefore, considering the above, in the present invention, the Si is limited to an upper limit of 0.15% to improve the thermal fatigue strength. Further, reduction of the amount of Si to less than 0.02% increases the cost in refining, so the lower limit was made 0.02%. When desiring improvement of the thermal fatigue strength more, the range is preferably made 0.02% to 0.10%.

Mn is an ingredient unavoidably included in steel. It has the effect of increasing the amount of oxide scale at a high temperature, so Mn should be reduced as much as possible. Further, if reducing the Mn, an improvement in the formability may also be expected. Therefore, the upper limit of Mn was made not more than 0.2%. Reduction of the amount of Mn to less than 0.2% increases the cost in refining, so it is also possible to set a lower limit of 0.05%.

P is an ingredient unavoidable included in steel, but if contained in an amount over 0.040%, the weldability falls, so the upper limit was made 0.040%.

S is an ingredient unavoidably included in steel, but if contained in an amount of over 0.010%, it forms MnS and reduces the corrosion resistance, so the upper limit was made 0.010%.

Al is extremely useful as a deoxidizing element. In the present invention, to limit the Si to an extremely low level, addition of Al as a deoxidizing agent is essential. For sufficient deoxidation, the amount of Al in the steel after deoxidation must be made at least 0.005%. However, if added in excess, the formability deteriorates and the high temperature fatigue strength due to internal oxidation falls, so the upper limit was made 0.10%.

N is an unavoidable impurity contained in steel. Like with C, the formability deteriorates and the weldability falls. Therefore, it is desirable that it be as small in content as possible. Therefore, the content was made not more than 0.020%. Note that reduction to less than 0.005% increases the cost in refining, so it is also possible to set a lower limit of 0.005%.

Cr is an element forming a protective $Cr_2O_3$ film and improving the oxidation resistance. In the present invention, to reduce the amount of Si as much as possible, the Cr has to be a minimum of 15% so as to maintain the oxidation resistance. Further, if incorporating Cr in an amount over 18%, the formability falls, so the upper limit was made 18%.

Mo is an element required for securing a high temperature strength in the present invention. Further, there is also the effect of improving the oxidation resistance and corrosion resistance. Accordingly, Mo is added in the range of 1.5% to 2.0%. If less than 1.5%, a sufficient high temperature strength cannot be obtained, while if added in an amount of over 2.0%, the formability deteriorates.

The role of Ti in the present invention is to suppress the consumption of the expensive Nb effective for the high temperature strength since the ability to stabilize C and N as a carbonitride is higher than Nb. If the amount added is less than 3×(C+N)%, the effect is poor, while if over 0.25%, the formability deteriorates.

Nb is an element required for securing the high temperature strength along with Mo. In addition, along with Ti, it has the function of stabilizing the C and N as a carbonitride. However, if less than 0.4%, the necessary high temperature strength cannot be secured. Further, even if added over 0.8%, the high temperature strength does not increase and the formability deteriorates. Therefore, the amount of Nb added was made 0.4% to 0.8%.

B is also added since it is useful for improving the thermal fatigue strength. It is believed that B segregates at the grain boundaries and suppresses grain growth when exposed to a high temperature. Further, there is also the effect of improvement of the secondary formability. However, if the amount of B is less than 0.0003%, these effects are not exhibited. Further, if added in an amount of over 0.0050%, the primary processability is degraded.

Further, regarding C and N, if the amount of C+N exceeds 0.03%, the formability drops, so this value was made the upper limit. In the present invention, Ti is mainly consumed for stabilizing the C and N as a carbonitride, but Nb also forms a carbonitride with C and N. However, Nb increases the high temperature strength, so presence as dissolved Nb is essential. To prevent a drop in the amount of dissolved Nb, C+N is desirably as low as possible. It is more preferable that the amount of C+N be not more than 0.015%.

Further, for sufficient deoxidation, Al, Si, and Mn are set so that the value of Al×(Si+Mn) becomes 0.001 to 0.020. If this value is less than 0.001, the deoxidizing elements are insufficient and sufficient deoxidation is impossible. The variation in composition also becomes large. Further, if over 0.020, the contents of Al, Si, and Mn become too great and the thermal fatigue strength, high temperature fatigue strength, and oxidation resistance are inferior.

The steels of the present invention adjusted in composition to the above are superior in high temperature strength and have extremely superior thermal fatigue strength. The 0.2% proof stress at 900° C. before heat treatment in the atmosphere at 900° C. for 300 hours was at least 15 MPa. The difference before and after heat treatment was not more than 5 MPa. If the 0.2% proof stress of 900° C. is less than 20 MPa, the initial high temperature strength is insufficient and not preferable for an exhaust manifold application. Deformation easily occurs during use as a member. If the difference before and after heat treatment is over 5 MPa, even if the initial strength is 20 MPa or more, the drop in strength during use as a member is large and deformation etc. easily occur.

The production conditions of the present invention are not particularly fixed, but the following conditions are desirable. The steels of the present invention are limited in the deoxidizing elements, so it is preferable to melt them using converter-secondary refining or a vacuum melting furnace. Further, a slab or an ingot of the desired ingredients is processed to the final product through heat treatment-annealing of hot rolled sheet-cold rolling-annealing and pickling. In accordance with need, the annealing of the hot rolled coil may be omitted. The cold rolling and annealing and pickling may be repeated. Below, the present invention will be explained in further detail by examples.

EXAMPLE 1

50 kg steel ingots having the chemical compositions shown in Table 1 were each melted in a vacuum melting furnace, heated from 1150° C. to 1280° C., and hot rolled to obtain a hot roll sheet having a thickness of 5 mm. At this time, the hot rolling starting temperature was 1100° C. to 1250° C. and the hot rolling end temperature was 800° C. to 900° C. After this, the hot rolled sheet was heated from 900° C. to 1000° C. and held there for 60 seconds for annealing of the hot rolled sheet. Further, the sheet was cold rolled to obtain a cold rolled sheet having a thickness of 2 mm, then was heated to 1050° C. and held there for 60 seconds for final annealing. The sheet was then pickled by fluoric acid to obtain a steel sheet used as a test steel.

TABLE 1

| Steel no. | C | Si | Mn | P | S | Al | N | Cr | Mo | Ti | Nb | B | C + N | 3 × (C + N) | Al × (Si + Mn) | Remarks |
|---|---|---|---|---|---|---|---|---|---|---|---|---|---|---|---|---|
| A | 0.005 | 0.06 | 0.1 | 0.03 | 0.005 | 0.02 | 0.01 | 16.5 | 1.8 | 0.15 | 0.45 | 0.0004 | 0.015 | 0.045 | 0.0032 | Inv. steel |
| B | 0.005 | 0.3 | 0.12 | 0.02 | 0.007 | 0.03 | 0.0105 | 16.5 | 1.8 | 0.16 | 0.45 | 0.0004 | 0.0155 | 0.0465 | 0.0126 | Comp. steel |
| C | 0.005 | 0.9 | 0.1 | 0.03 | 0.006 | 0.02 | 0.0103 | 16.5 | 1.8 | 0.15 | 0.44 | 0.0004 | 0.0153 | 0.0459 | 0.02 | Comp. steel |
| D | 0.003 | 0.04 | 0.1 | 0.03 | 0.001 | 0.015 | 0.011 | 16.1 | 1.7 | 0.15 | 0.47 | 0.0008 | 0.014 | 0.042 | 0.0021 | Inv. steel |
| E | 0.01 | 0.09 | 0.15 | 0.01 | 0.003 | 0.05 | 0.012 | 17.5 | 1.6 | 0.1 | 0.55 | 0.0012 | 0.022 | 0.066 | 0.012 | Inv. steel |
| F | 0.03 | 0.06 | 0.13 | 0.02 | 0.004 | 0.02 | 0.03 | 16.5 | 1.8 | 0.15 | 0.43 | 0.0004 | 0.06 | 0.18 | 0.0038 | Comp. steel |
| G | 0.005 | 0.03 | 0.05 | 0.02 | 0.003 | 0.008 | 0.009 | 16.4 | 1.7 | 0.15 | 0.43 | 0.0004 | 0.014 | 0.042 | 0.00064 | Comp. steel |
| H | 0.005 | 0.08 | 0.11 | 0.03 | 0.001 | 0.15 | 0.007 | 16.6 | 1.7 | 0.15 | 0.45 | 0.0016 | 0.015 | 0.045 | 0.0285 | Comp. steel |
| I | 0.006 | 0.08 | 0.12 | 0.03 | 0.001 | 0.02 | 0.008 | 17.0 | 1.6 | 0.2 | 0.45 | 0.0001 | 0.014 | 0.042 | 0.004 | Comp. steel |
| J | 0.007 | 0.06 | 0.12 | 0.03 | 0.001 | 0.02 | 0.007 | 17.1 | 1.6 | 0.22 | 0.45 | 0.0080 | 0.014 | 0.042 | 0.0036 | Comp. steel |
| K | 0.006 | 0.07 | 0.12 | 0.02 | 0.001 | 0.04 | 0.012 | 14.2 | 1.6 | 0.2 | 0.5 | 0.0005 | 0.018 | 0.054 | 0.0076 | Comp. steel |
| L | 0.011 | 0.08 | 0.13 | 0.03 | 0.003 | 0.03 | 0.008 | 19.1 | 1.6 | 0.16 | 0.48 | 0.0008 | 0.019 | 0.057 | 0.0063 | Comp. steel |
| M | 0.009 | 0.08 | 0.12 | 0.03 | 0.002 | 0.02 | 0.007 | 17.0 | 1.0 | 0.17 | 0.45 | 0.0012 | 0.016 | 0.048 | 0.004 | Comp. steel |
| N | 0.008 | 0.08 | 0.11 | 0.03 | 0.001 | 0.02 | 0.007 | 17.2 | 2.5 | 0.15 | 0.45 | 0.0016 | 0.015 | 0.045 | 0.0038 | Comp. steel |

First, these test steels were subjected to an ordinary temperature tensile test and high temperature tensile test before heat treatment. The high temperature tensile test was conducted at 900° C. Further, the test steels were heat treated in the atmosphere at 900° C. for 300 hours, then measured for high temperature strength at 900° C. and evaluated for the thermal fatigue strength. As an indicator of the formability, ordinary temperature elongation was used. The ordinary temperature tensile test was conducted based on JIS Z 2241. The direction of the test pieces measured was the rolling direction (L direction). The overall elongation value was made the ordinary temperature elongation (El). The test pieces used were all No. 13B test pieces defined in JIS Z 2201. Further, the indicator of the high temperature strength was the 0.2% proof stress (PS) at 900° C. The high temperature tensile test was conducted based on JIS G 0567. The direction of the test piece in the high temperature tensile test was the rolling direction (L direction). The results of the ordinary temperature tensile test and high temperature tensile test are shown together in Table 2.

TABLE 2

| Steel no. | Ordinary temp. El (%) | Initial high temp. strength 0.2% proof stress (at 900° C.) | High temp. strength after heat treatment 0.2% proof stress (at 900° C.) | Remarks |
|---|---|---|---|---|
| A | 35 | 22 | 19 | |
| B | 33 | 22 | 16 | Large amount of Si added, large drop in high temp. strength |
| C | 29 | 20 | 10 | Large amount of Si added, large drop in high temp. strength |
| D | 35 | 23 | 20 | |
| E | 34 | 24 | 21 | |
| F | 29 | 19 | 16 | Large C, N, small Ti, so smaller dissolved Nb and low initial high temp. strength |
| G | 29 | 22 | 18 | Small deoxidizing elements and low ordinary temp. elongation |
| H | 29 | 22 | 15 | Drop in high temp. fatigue strength, increase in amount of oxidation |
| I | 35 | 21 | 14 | No B added, so large drop in high temp. strength |
| J | 29 | 22 | 17 | Large B, so low ordinary temp. elongation |
| K | 34 | 21 | 16 | Large peeling of scale |
| L | 28 | 21 | 14 | Large Cr, so low ordinary temp. elongation |
| M | 34 | 17 | 14 | Small Mo, so low initial high temp. strength |
| N | 28 | 24 | 20 | Large Mo, so low ordinary temp. elongation |

The steel A to the steel C were test steels based on 16.5% Cr-1.8% Mo-0.45% Nb-0.15% Ti steel changed in only the amount of Si. The steel A of the present invention had an ordinary temperature elongation of 30% or more and an initial high temperature strength before heat treatment of a superior 22 MPa. The high temperature strength after heat treatment at 900° C. for 300 hours was also a high 19 MPa. The difference before and after heat treatment was only 3 MPa, so a superior thermal fatigue strength was exhibited. As opposed to this, the steel B of the comparative example having an Si content of 0.3% had an initial high temperature strength of 22 MPa, but the high temperature strength after heat treatment was 16 MPa or down 6 MPa from the initial high temperature strength. The steel C of the comparative example with a further higher Si content also had a lower initial high temperature strength and a high temperature strength after heat treatment of a considerably lower 10 MPa. The drop in the strength from the initial high temperature strength also was an extremely large 10 MPa.

The steel D and the steel E changed in ingredients in the range of the present invention had initial high temperature strengths of 20 MPa or more, had high temperature strengths after heat treatment of 15 MPa or more, had differences in high temperature strengths before and after heat treatment of 5 MPa or less, and were superior in thermal fatigue strengths.

Next, the results of the steel F to steel N of the comparative examples will be explained. The steel F had high amounts of C and N and a small amount of Ti, so Nb was consumed for immobilizing them as carbonitrides and the initial high temperature strength was low. The steel G with extremely little deoxidizing elements was insufficient in deoxidation and had a value of the ordinary temperature elongation of a low 29%. The steel H with the high Al and Al×(Si+Mn) had a low elongation of 29% and a large drop in strength after heat treatment. Further, the high temperature fatigue strength at 900° C. dropped 30% or more compared with the steels of the present invention. The steel I with no B added was insufficient in initial strength, but had a large drop in strength after heat treatment. The steel J with too great a B had an ordinary temperature elongation of a low 29% or poor formability. The steel K with little Cr had greater peeling of scale during heat treatment at 900° C. for 300 hours compared with the steels of the present invention indicating that the oxidation resistance was inferior. The steel L with a large Cr had an ordinary temperature elongation of a low 28%. The steel M with little Mo had a low high temperature strength, while the steel N with a large Mo had an ordinary temperature elongation of a low 28%. From the above, the ferrite stainless steels of the present invention clearly are superior in thermal fatigue strength.

According to the present invention, it is possible to provide ferrite stainless steel superior in thermal fatigue strength useful for an automobile exhaust system member, in particular an exhaust manifold, so it is possible for not only the manufacturers, but also users of the steels to obtain tremendous advantages.

While the invention has been described with reference to specific embodiments chosen for purpose of illustration, it should be apparent that numerous modifications could be made thereto by those skilled in the art without departing from the basic concept and scope of the invention.

What is claimed is:

1. A ferrite stainless steel for an automobile exhaust system member superior in thermal fatigue strength consisting of, by wt %, C: 0.020% or less, Si: 0.02 to 0.15%, Mn: 0.05 to 0.20%, P: 0.040% or less, S: 0.010% or less, Al: 0.005 to 0.10%, N: 0.020% or less, Cr: 15 to 18%, Mo: 1.5 to 2.0%, Ti: 3×(C+N) to 0.25%, Nb: 0.4 to 0.8%, B: 0.0003 to 0.0050% said C and N satisfying the relationship of C+N: 0.030% or less, and said Al, Si, and Mn satisfying the relationship of Al×(Si+Mn): 0.001 to 0.020, and a balance of Fe and unavoidable impurities.

2. A ferrite stainless steel for an automobile exhaust system member superior in thermal fatigue strength as set forth in claim 1, wherein the 0.2% proof stress at 900° C. before heat treatment in the atmosphere at 900° C. for 300 hours is at least 15 MPa and wherein a difference of the 0.2% proof stress before and after the heat treatment is not more than 5 MPa.

* * * * *